United States Patent [19]

Perez, Jr.

[11] 4,365,579

[45] Dec. 28, 1982

[54] SURVIVAL CAPSULE MODULE AND METHODS OF CONSTRUCTING AND UTILIZING

[76] Inventor: Lorenzo Perez, Jr., P.O. Box 446, Sault Ste. Marie, Mich. 49783

[21] Appl. No.: 152,519

[22] Filed: May 22, 1980

Related U.S. Application Data

[63] Continuation of Ser. No. 923,164, Jul. 10, 1978, abandoned.

[51] Int. Cl.[3] ..... B63C 9/02

[52] U.S. Cl. ..... 114/349; 114/365

[58] Field of Search ..... 9/3, 4 R, 4 A, 11 R, 9/30; 114/322, 323, 348, 349, 350, 365; 441/38, 87

[56] References Cited

U.S. PATENT DOCUMENTS

| | | | |
|---|---|---|---|
| 1,159,683 | 11/1915 | Keller | 114/323 |
| 2,077,477 | 4/1937 | Hellman | 114/323 |
| 2,348,777 | 5/1944 | Bessire | 114/323 |

FOREIGN PATENT DOCUMENTS

| | | | |
|---|---|---|---|
| 626357 | 9/1927 | France | 114/322 |
| 1194627 | 11/1959 | France | 9/4 R |
| 974336 | 11/1964 | United Kingdom | 9/4 R |

*Primary Examiner*—Trygve M. Blix
*Assistant Examiner*—Jesus D. Sotelo
*Attorney, Agent, or Firm*—Irving M. Weiner; Pamela S. Burt; John L. Shortley

[57] ABSTRACT

A life survival capsule for use on shipboard, of substantially spheroidal shape, having self-contained life suporting facilities and supplies for approximately 16 occupants, with double-hulled construction and a thermal insulating material between the hulls, restraint devices to prevent injury to occupants, multiple entrances or exits, including an entrance from the interior of the ship on which it is mounted, and automatic and manual release devices to free it from the ship to which it is attached.

6 Claims, 6 Drawing Figures

SURVIVAL CAPSULE MODULE AND METHODS OF CONSTRUCTING AND UTILIZING

This is a continuation of application Ser. No. 923,164, filed July 10, 1978 now abandoned.

The present invention relates generally to a buoyant survival capsule for a ship.

BACKGROUND OF THE INVENTION

This invention relates to life saving means for sea vessels, and lake vessels in particular where lifeboats are not satisfactory. Lake vessels navigate relatively shallow bodies of water, where severe storms can arise suddenly, and cause high waves, rendering the use of lifeboats impractical, should the need arise. Lifeboats may be damaged by being thrown against the hull of the ship during launching, or swamped by the waves. Also, high waves and violent seas may preclude entering a lifeboat from the deck of the vessel. After launching, should it be successfully accomplished, wave action may swamp the lifeboat, or injure its occupants by throwing them about inside the lifeboat.

Heretofore, there have been several attempts to solve the above-mentioned problems of lifeboats, which were cumbersome, awkward, complex, and not suitable for a sudden emergency.

In 1956, Ernst W. Nicol was granted U.S. Pat. No. 2,899,695, entitled "LIFEBOAT" which disclosed a powered, steerable, elongated lifeboat, which was covered by a large hatch, allowing a large open area for boarding from the deck of a vessel, and disclosing the use of either the large hatch or two small hatches for exit, depending on weather conditions.

In 1975, Charles E. Otherman was granted U.S. Pat. No. 3,896,515, entitled "BOAT CONSTRUCTION" disclosing a lifeboat with a triangular hull, for compact storage of a multitude of such units on the deck of a vessel, with a single entrance hatch and means of propulsion and steering.

In 1974, Harry X. Mousetis was issued U.S. Pat. No. 3,813,717, entitled "LIFE RAFT" and disclosing a one-man life raft, for use at sea.

In 1962, Tolvo J. Kaugas was issued U.S. Pat. No. 3,064,282, entitled "SURVIVAL CAPSULE", disclosing a lifeboat of generally oblate shape, to be mounted on brackets on the deck of a vessel used on the Great Lakes, and having a hatch covering a single opening on its uppermost surface, and retained to the mounting brackets by threaded pins.

In 1966, Charles E. Otterman was issued U.S. Pat. No. 3,259,926, entitled "LIFE SPHERE" disclosing a replacement for conventional lifeboats for seagoing passenger vessels, of spheroid shape.

SUMMARY OF THE INVENTION

The invention provides a device which fulfills the requirements for a device in the nature of a lifeboat particularly fitted to use in vessels which ply the Great Lakes, carrying cargo and a small crew.

It is an object of the invention to provide a life-saving craft which may be boarded by the crew of a lake vessel prior to the time of actual need.

It is a further object to provide such a craft that can be made airtight.

It is a further object to provide such a craft that can be entered without the need for going upon the deck of the vessel.

It is a further object to provide such a craft with means for automatically releasing it from a sinking ship, without the need for external lifting means.

It is a further object to provide a craft with a substantially smooth exterior to prevent it from becoming caught on some portion of the ship.

In a preferred embodiment, this life capsule is completely round in width and oval in height, 18′ across and 9′ high. It is built out of a sturdy and reinforced lightweight material such as reinforced fiberglass. It is painted international yellow or orange. On the outside of the capsule are recessed hooks to facilitate rescue or enable a small vessel to tow the capsule to safety. The capsule has a double hull, with a thermal insulating material between layers. It holds 16 persons. Occupants would be completely protected from the elements. There are two entry-escape hatches, water tight. It has four escape hatches. It is completely self-contained and will run off batteries for power, radio communication or transmission, electricity, and lights. Oxygen will be supplied by tanks sufficient for twelve hours. Four access panels placed on the floor at certain points will contain food, medical supplies, and storage for oxygen tanks and batteries. The cabin area is six feet in height at the highest point with two ladders in the center from the floor to the top hatch. The control consoles will have gauges to determine depth of release from 10 ft. to 50 ft., automatic, and also manual levers to activate release of the survival capsule from ship should the automatic release malfunction.

Below deck is three feet in depth comprising the storage areas previously described, with ballast compartment and a central entry way three feet in diameter with double watertight hatches. Seating will be designed similar to aerobatic aircraft seats, with both lap and upper torso safety belts.

This capsule is intended to be positioned over a cabin. It would be accessible from inside the ship cabin, with a ladder from the cabin to the capsule. This would protect the crew from extreme weather conditions and debris that might break off from the ship. The capsule is attached to the ship by explosive bolts released when the capsule achieves a preset depth below the surface of the water. By having the capsule release below the surface of the water, it will not prematurely release while the ship is sinking. While the survival capsule is connected to the ship, it would have an umbilical cord that will provide electricity to charge the batteries and air circulation. The capsule will be sealed until the captain, or a designate, breaks the seal and allows the crew inside during a storm.

A ship equipped with this capsule would utilize it in the following manner: There would be one capsule in the forward section and one in the after section. In time of a severe storm the captain or designate will break the seal and allow the crew not on active duty to enter for the duration of the storm. If the danger subsides, the capsule will be evacuated and resealed. Should it become necessary to utilize the lift capsule, it will be sealed from the inside by the crew but remain in communication with the ship till the umbilical cord is ruptured at time of release. The capsule will float to the surface with 4′ exposed above water. The crew then may activate communication equipment, and a permanently mounted flare gun.

It is a further object to provide such a craft with a double hull containing an insulating medium, said insulation serving both as a thermal insulation, but also to distribute impact shocks and prevent rupture of the hulls.

It is a further object to provide such a craft that is completely independent of its exterior environment for a period of up to twelve hours.

It is a further object to provide such a craft capable of withstanding an external pressure of two hundred feet of water.

DETAILED DESCRIPTION

Figures 1, 2, 3, 4, 5, 6:
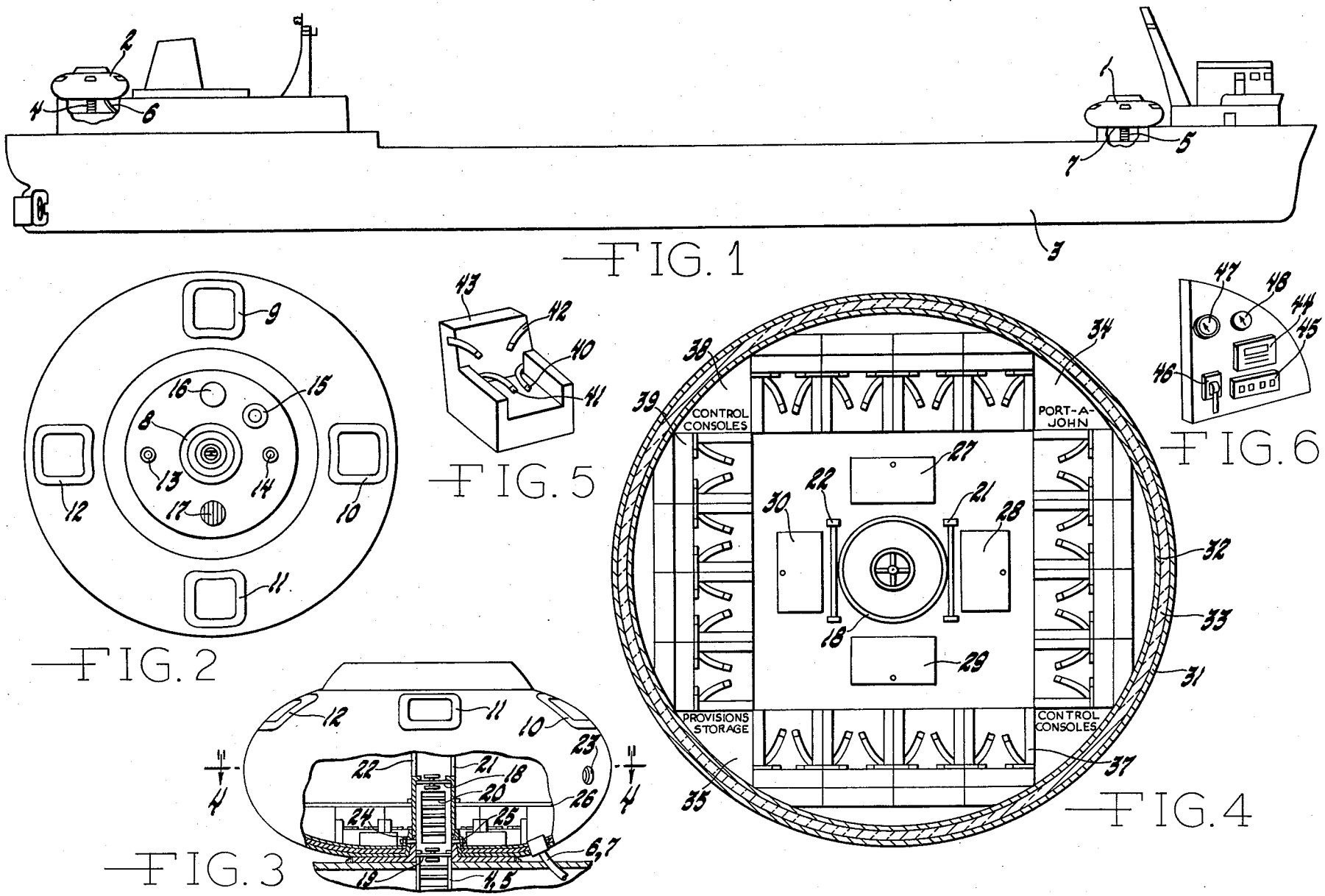
FIG. 1 is a side elevation of a cargo-carrying vessel showing the placement and means of access from the ship of two embodiments of the instant invention.
FIG. 2 is a top plan view of an embodiment of the instant invention.
FIG. 3 is a sectional side view.
FIG. 4 is a sectional top view.
FIG. 5 is an illustration of a seat showing the safety belt arrangement.
FIG. 6 is an illustration of a control panel.

As shown in FIG. 1, two embodiments of the instant invention, 1 and 2, are mounted on ship 3 above cabins at both ends of said ship, and accessible from said cabins by means of ladders 4 and 5, and drawing power from said ship to maintain batteries in a charged condition, and operate ventillation equipment within said craft and maintain communication with the ship through plug-connected umbilical cables 6 and 7.

As shown in FIG. 2, the illustrated embodiment incorporates a central hatch 8, openable from either the interior or exterior, four escape hatches 9, 10, 11, 12 two radio antennas for radio communication frequencies and emergency location transmission frequency, 13 and 14, a flare gun 15, a light 16, and a self-closing ventilation device 17.

As shown in FIG. 3, hatches 18 and 19, and ladder 20, are so arranged to allow entry and exit from the capsule should it become necessary, without allowing substantial water entrance to the interior of the illustrated embodiment, and ladders 21 and 22 allowing access to the upper hatch opening 8. A diaphragm type pressure switch 23 of a commercially available type is shown, and is adjustable to cause explosive bolts 24 and 25 to release the illustrated embodiment from the ship at a predetermined depth. Beneath deck 26 are compartments for electrical storage batteries, oxygen tanks and food and medical supplies.

As shown in FIG. 4, the space under the deck is accessible through hatches 27, 28, 29 and 30. Also shown are outer hull 31, inner hull 32, and thermal insulating medium 33, such as insulating foam, and seating facilities which are also depicted in FIG. 5, a chemical toilet 34 of any commercially-available type of appropriate size, a cabinet 35 for storage of provisions, and control consoles 36, 37, 38 and 39.

FIG. 5 is an illustration of a typical seat, showing lap belts 40 and 41, and belts 42 and 43 to be connected about the occupant's upper torso at the chest level.

FIG. 6 is an illustration of a typical control panel for various functions. The illustration shows means for communicating with the ship using a commercially available intercom device, with speaker/microphone 44 and selector switches 45, means 46 for manually controlling explosive bolts 24 and 25, and meters 47 and 48 for monitoring battery voltage and current. Other control panels, (not shown) control the ventilation equipment, the radio equipment and beacon light, internal lighting, and the flow from the oxygen supply.

The present invention may be embodied in other specific forms without departing from the essential characteristics or spirit of the instant invention, and numerous modifications would be obvious to one skilled in the art. The present embodiment is therefore to be considered in all respects as illustrative and not restrictive. The scope of the invention is indicated by the appended claims rather than by the foregoing description. Furthermore, all changes which come within the meaning and range of the appended claims are therefore intended to be embraced therein.

I claim:

1. A buoyant survival capsule for a ship, comprising:

a buoyant survival capsule body having a substantially oblate spheroidal shape;

said body having an inner hull and an outer hull disposed in a fixed; spaced-apart, and substantially coextensive predetermined relationship;

first means for supporting said buoyant survival capsule body on a deck of said ship;

said first means including a tapered annular hollow conical frustrum body firmly attachable to the deck of said ship over a hatch in said deck;

second means for providing direct access from the interior of the ship to the interior of said buoyant survival capsule body comprising a second hollow conical member closely receiving and abutting said first means annular conical frustrum body and extending inwardly and upwardly therefrom to a position above said first means, and said second means including a hatch chamber received within said second means conical member and forming an upwardly extending continuation of said first means conical body and said second means second conical member with said hatch chamber forming a hollow continuation of the hollow portion of said first means;

said hatch chamber extending a substantial distance upwardly into said capsule body and a substantial distance above said first means;

a ladder within said hatch chamber extending from substantially the bottom to the top thereof;

a hatch adjacent the upper end of said hatch chamber for closing the latter.

2. A survival capsule according to claim 1, including:

the space between said inner hull and said outer hull being occupied by a thermal insulating material.

3. A survival capsule according to claim 1, including:

a plurality of seats within said capsule body;

each said seat having one or more pairs of straps; and each strap of said pair of straps having means which adjustably interconnect with each other.

4. A survival capsule according to claim 1, including:

a plurality of exit means;

said exit means being disposed in an upper surface of said capsule body; and each such exit means being watertight.

5. A survival capsule according to claim 1, including:

means for chemically storing electrical energy;

means for storing oxygen under pressure;

means for releasing said stored oxygen into the interior of said capsule body;

means for controlling the rate of release of said oxygen; and means for controlling the air pressure within said capsule body.

6. A survival capsule according to claim 1 or 5, including:

disconnectable means for receiving electrical energy from said ship; and disconnectable means of communication between the interior of said capsule body and the interior of said ship.

* * * * *